US010927860B2

(12) United States Patent
Kudo et al.

(10) Patent No.: US 10,927,860 B2
(45) Date of Patent: Feb. 23, 2021

(54) FLUIDIC CYLINDER

(71) Applicant: SMC CORPORATION, Chiyoda-ku (JP)

(72) Inventors: Masayuki Kudo, Tsukubamirai (JP); Shinichiro Nemoto, Tsukubamirai (JP); Masahiko Kawakami, Tsukubamirai (JP); Yuu Mizutani, Tsukubamirai (JP); Eiko Miyasato, Tsukubamirai (JP); Ken Tamura, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/084,038

(22) PCT Filed: Dec. 27, 2016

(86) PCT No.: PCT/JP2016/088855
§ 371 (c)(1),
(2) Date: Sep. 11, 2018

(87) PCT Pub. No.: WO2017/158987
PCT Pub. Date: Sep. 21, 2017

(65) Prior Publication Data

US 2019/0195248 A1 Jun. 27, 2019

(30) Foreign Application Priority Data

Mar. 17, 2016 (JP) ..... JP2016-053499

(51) Int. Cl.
*F15B 15/14* (2006.01)
*F15B 15/28* (2006.01)

(52) U.S. Cl.
CPC ..... *F15B 15/1438* (2013.01); *F15B 15/14* (2013.01); *F15B 15/1428* (2013.01);
(Continued)

(58) Field of Classification Search
CPC ..... F15B 15/1419; F15B 15/1433; F15B 15/1438; F15B 15/2861
See application file for complete search history.

(56) References Cited

U.S. PATENT DOCUMENTS 3,180,236 A * 4/1965 Beckett ..... F15B 15/1414 92/164
3,688,646 A * 9/1972 Flick ..... F15B 15/1433 92/161

(Continued)

FOREIGN PATENT DOCUMENTS

DE 24 48 028 A1 4/1976
DE 86 28 149 U1 11/1987

(Continued)

OTHER PUBLICATIONS

German Office Action dated May 9, 2019 in Patent Application No. 10 2016 006 596.5, 4 pages.

(Continued)

*Primary Examiner* — Abiy Teka
*Assistant Examiner* — Matthew Wiblin
(74) *Attorney, Agent, or Firm* — Oblon, McClelland, Maier & Neustadt, L.L.P.

(57) ABSTRACT

A fluidic cylinder has a cylinder tube having a cylinder chamber defined in an interior thereof has a pair of cover members attached to respective ends of the cylinder tube. A piston is disposed displaceably along the cylinder chamber, and a piston rod is connected to the piston. The piston and the cylinder tube are formed with rectangular shapes in cross section, the piston includes a wear ring which is in sliding contact with an inner wall surface of the cylinder tube, and a magnet is incorporated in the wear ring. At least one of the cover members includes bolt holes therein, the bolt holes extending in at least two or more directions including a direction in which the piston is displaced, and fastening bolts (Continued)

are selectively inserted into the bolt holes to fix the at least one of the cover members with respect to another member.

1 Claim, 15 Drawing Sheets

(52) U.S. Cl.
CPC ..... *F15B 15/1447* (2013.01); *F15B 15/2861* (2013.01); *F15B 15/28* (2013.01)

(56) References Cited

U.S. PATENT DOCUMENTS 4,080,877 A * 3/1978 deFries ..... F15B 15/1414 92/146
4,726,282 A * 2/1988 LaBair ..... F15B 15/1438 92/159
4,909,130 A * 3/1990 LaBair ..... F15B 15/1438 92/128
4,928,577 A * 5/1990 Stoll ..... F15B 15/1419 277/436
5,400,696 A 3/1995 Weber
5,477,774 A 12/1995 Ikumi
6,152,015 A * 11/2000 Migliori ..... F15B 15/1419 92/177
2006/0197389 A1* 9/2006 Terasaki ..... F15B 15/2861 310/14
2010/0319530 A1 12/2010 Ryu
2017/0298931 A1* 10/2017 Kudo ..... F04B 39/0292

FOREIGN PATENT DOCUMENTS

DE 29903825 U1 * 5/1999 ..... B25B 5/122
JP 4-7705 U 1/1992
JP 6-235405 A 8/1994
JP 7-23859 U 5/1995
JP 2001-234903 A 8/2001
JP 4637678 12/2010
JP 2011-508127 A 3/2011

OTHER PUBLICATIONS

International Search Report dated Feb. 21, 2017, in PCT/JP2016/088855, filed Dec. 27, 2016.
Office Action dated May 14, 2020 in India Patent Application No. 201847038390 (5 pages).

* cited by examiner

FLUIDIC CYLINDER

TECHNICAL FIELD

The present invention relates to a fluidic (hydraulic) cylinder adapted to displace a piston in an axial direction under a supplying action of a pressure fluid.

BACKGROUND ART

Conventionally, a fluidic cylinder having a piston which is displaced under a supplying action of a pressure fluid has been used as a means for conveying workpieces or the like.

For example, as disclosed in Japanese Laid-Open Patent Publication No. 6-235405, such a fluidic cylinder includes a cylindrically shaped cylinder tube, a cylinder cover disposed at an end portion of the cylinder tube, and a piston provided displaceably in the interior of the cylinder tube. In addition, by forming the cross-sectional shape thereof perpendicular to an axial line of the piston and the cylinder tube in a non-circular shape, it is possible to increase a pressure receiving area of the piston and thereby increase the thrust force, as compared with a case in which a piston having a circular cross section is used.

In addition, in Japanese Laid-Open Patent Publication No. 2011-508127 (PCT), a cylinder device is disclosed having a piston with a rectangular shape in cross section. In this cylinder device, the cross-sectional shape of the cylinder housing is formed with a rectangular shape in cross section corresponding to the cross-sectional shape of the piston. Additionally, sealing members are disposed respectively via a groove on outer edge portions of the piston, and the seal members are brought into contact with an inner wall surface of the cylinder housing to thereby provide sealing.

SUMMARY OF INVENTION

In a fluidic cylinder having a non-circular piston, as disclosed in the aforementioned Japanese Laid-Open Patent Publication No. 6-235405 and Japanese Laid-Open Patent Publication No. 2011-508127 (PCT), there is a demand to reduce the size in the longitudinal dimension along the axial direction. Further, a demand also is sought to install the same fluidic cylinder in various orientations (directions) depending on the environment of use and the purpose for which the fluidic cylinder is to be used.

A general object of the present invention is to provide a fluidic cylinder which is capable of achieving a reduction in size in the longitudinal dimension while increasing the thrust force, and at the same time improving the ability to mount the fluidic cylinder.

The present invention is characterized by a fluidic cylinder including a cylinder tube having a cylinder chamber defined in an interior thereof, a pair of cover members attached to both ends of the cylinder tube, a piston disposed displaceably along the cylinder chamber, and a piston rod that is connected to the piston;

wherein the piston and the cylinder tube are formed with rectangular shapes in cross section, the piston includes a wear ring which is in sliding contact with an inner wall surface of the cylinder tube, a magnet is incorporated in the wear ring, and together therewith, the cover member includes bolt holes therein extending in at least two or more directions including a direction in which the piston is displaced, and fastening bolts are selectively inserted into the bolt holes and fixed with respect to another member.

According to the present invention, in the fluidic cylinder, the piston and the cylinder tube are formed with rectangular shapes in cross section, and the magnet is incorporated in the wear ring that constitutes the piston and is in sliding contact with the inner wall surface of the cylinder tube. Due to this configuration, an axial dimension along the direction in which the piston is displaced can be suppressed, in comparison with a fluidic cylinder in which the wear ring and the magnet are disposed in parallel in the axial direction on an outer peripheral surface of the piston. As a result, by securing a large pressure receiving area due to the piston having a rectangular cross section, while a large thrust force is obtained, it is also possible to reduce the longitudinal dimension of the fluidic cylinder including the piston.

Further, by forming the bolt holes in the cover member, which extend in at least two directions or more including the displacement direction of the piston, and selectively inserting the fastening bolts into the bolt holes and fixing the bolt holes to another member, for example, since the fluidic cylinder can be fixed in at least two or more different directions depending on the environment of use, the ability to mount the fluidic cylinder can be improved.

The above and other objects, features, and advantages of the present invention will become more apparent from the following description when taken in conjunction with the accompanying drawings, in which a preferred embodiment of the present invention is shown by way of illustrative example.

DESCRIPTION OF EMBODIMENTS

Figure 1:
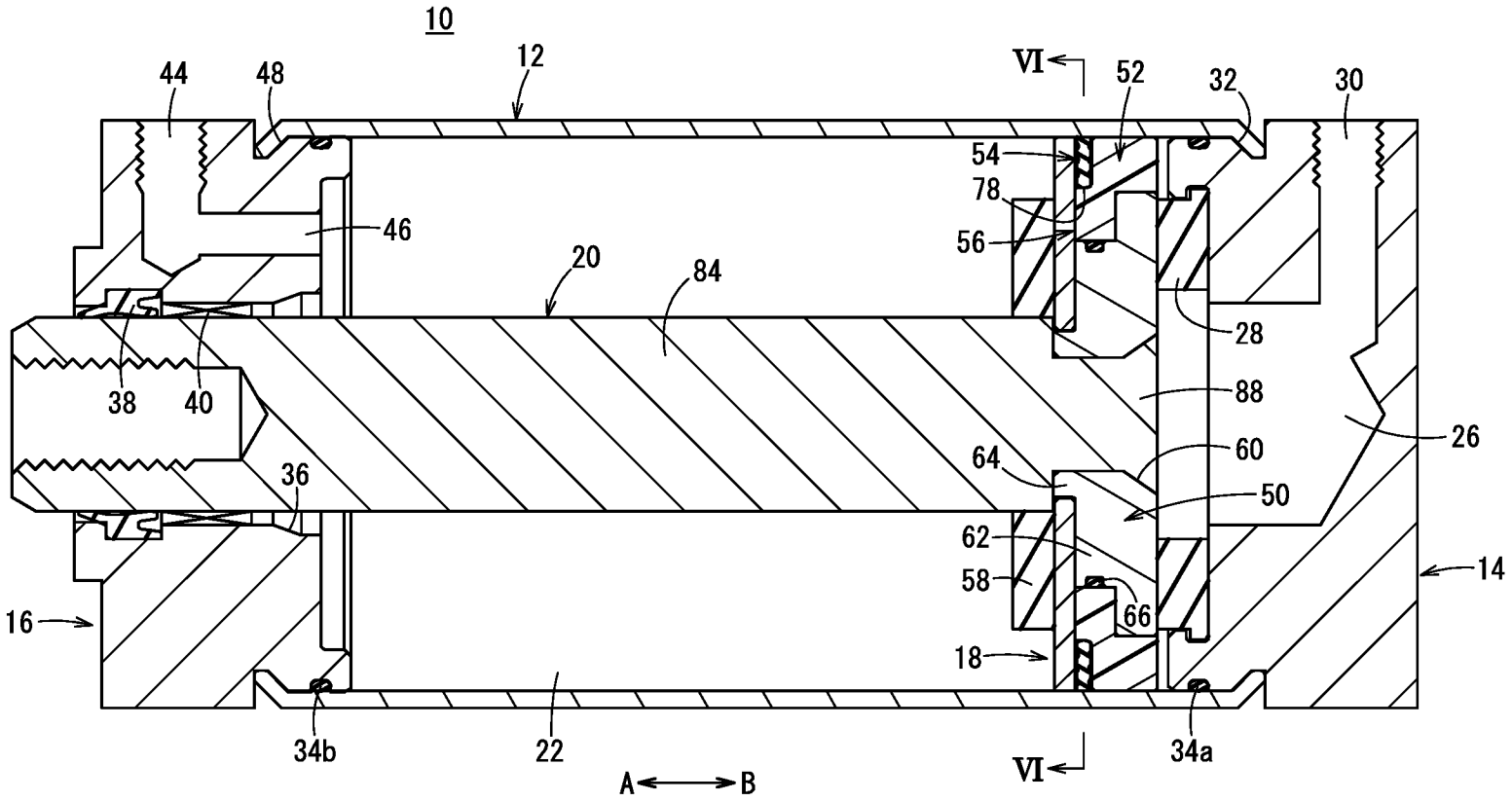
FIG. 1 is an overall cross-sectional view of a fluidic cylinder according to an embodiment of the present invention.

As shown in FIG. 1, the fluidic cylinder includes a cylinder tube 12 having a rectangular cross section, a head cover (cover member) 14 that is mounted on one end of the cylinder tube 12, a rod cover (cover member) 16 that is mounted on another end of the cylinder tube 12, a piston unit (piston) 18 that is disposed for displacement in the interior of the cylinder tube 12, and a piston rod 20 that is connected to the piston unit 18.

The cylinder tube 12, for example, is constituted from a tubular body that is formed from a metal material, and extends with a constant cross-sectional area along the axial direction (the direction of arrows A and B), and in the interior thereof, a cylinder chamber 22 is formed in which the piston unit 18 is accommodated.

Figure 2:
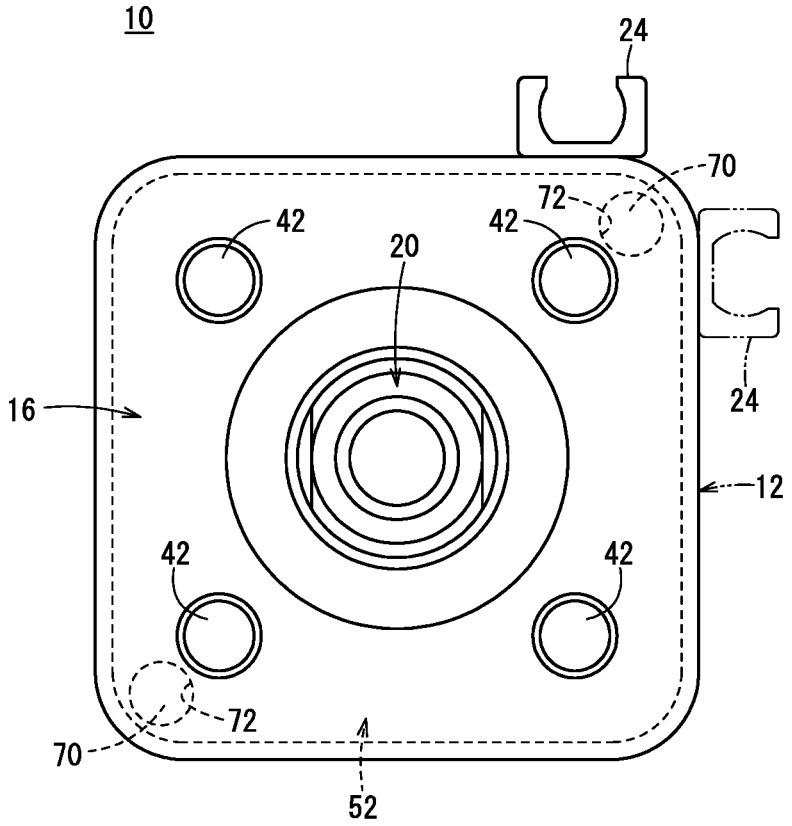
FIG. 2 is a front view of the fluidic cylinder of FIG. 1 as viewed from the side of a rod cover.

Further, as shown in FIG. 2, a sensor mounting rail 24 for enabling a non-illustrated detection sensor to be mounted therein is provided outside the cylinder tube 12. The sensor mounting rail 24 is formed with a U-shape in cross section opening in a direction away from the cylinder tube 12, and has a predetermined length along the axial direction (the direction of arrows A and B) of the cylinder tube 12, together with being mounted in the vicinity of a corner of the cylinder tube 12 which has a rectangular shape in cross section. In addition, a detection sensor for detecting a position along the axial direction of the piston unit 18 is mounted and retained in the sensor mounting rail 24.

As shown in FIG. 1, the head cover 14 is formed, for example, from a metal material having a substantially rectangular shape in cross section, and a communication hole 26 is formed at a predetermined depth in the center of the head cover 14 so as to face toward the side of the cylinder tube 12 (in the direction of the arrow A), and together therewith, a first damper 28 is mounted on an outer peripheral side of the communication hole 26 via a groove that is formed at an end portion of the head cover 14. The first damper 28, for example, is formed in a ring shape from an elastic material, and an end portion thereof is disposed so as to protrude slightly toward the cylinder tube 12 (in the direction of the arrow A) with respect to the end portion of the head cover 14.

On the other hand, a first fluid port 30 for supplying and discharging the pressure fluid is formed on a side surface of the head cover 14, and the first fluid port 30 communicates with the communication hole 26, whereby after the pressure fluid has been supplied to the first fluid port 30 from a non-illustrated pressure fluid supply source, the pressure fluid is introduced into the communication hole 26.

Further, on a side surface of the head cover 14, a first engagement groove 32, which is recessed toward an inner side, is formed at an end portion on the side of the cylinder tube 12 (in the direction of the arrow A) with respect to the first fluid port 30, and one end portion of the cylinder tube 12 is engaged with the first engagement groove 32 by being crimped toward the inner side. Consequently, the head cover 14 is connected integrally to the one end of the cylinder tube 12, and a seal member 34*a* provided on a side surface of the head cover 14 contacts the inner surface of the cylinder tube 12, whereby leakage of the pressure fluid having passed between the head cover 14 and the cylinder tube 12 is prevented.

Similar to the head cover 14, the rod cover 16 is formed, for example, with a substantially rectangular shape in cross section from a metal material, and a rod hole 36 that penetrates along the axial direction (the directions of arrows A and B) is formed in the center thereof. A rod packing 38 and a bush 40 are disposed on an inner circumferential surface of the rod hole 36 via an annular groove, and when the piston rod 20 is inserted into the rod hole 36, the rod packing 38 is placed in sliding contact with the outer circumferential surface of the piston rod 20, whereby leakage of pressure fluid having passed between the rod cover 16 and the piston rod 20 is prevented. On the other hand, by the bush 40 being placed in sliding contact with the outer circumferential surface, the piston rod 20 is guided in the axial direction (the direction of arrows A and B).

Further, as shown in FIG. 2, attachment holes 42 are formed in the end surface of the rod cover 16, respectively, in the vicinity of the four corners of the rod cover 16 at predetermined depths in the axial direction. For example, when the fluidic cylinder 10 is fixed to a non-illustrated other device or the like, fixing bolts (not shown) which have been inserted through the other device are screwed-engaged into the attachment holes 42 of the rod cover 16, thereby fixing the fluidic cylinder 10 to the other device.

On the other hand, as shown in FIG. 1, a second fluid port 44 for supplying and discharging the pressure fluid is disposed on a side surface of the rod cover 16, and the second fluid port 44 communicates with the cylinder chamber 22 via a communication passage 46 that extends along the axial direction (the direction of the arrow B) of the rod cover 16. In addition, the pressure fluid, which is supplied from the second fluid port 44, is introduced into the cylinder chamber 22 from the communication passage 46.

Further, on a side surface of the rod cover 16, a second engagement groove 48, which is recessed toward an inner side, is formed at an end portion on the side of the cylinder tube 12 (in the direction of the arrow B) with respect to the second fluid port 44, and another end portion of the cylinder tube 12 is engaged with the second engagement groove 48 by being crimped toward the inner side. Consequently, the rod cover 16 is connected integrally to the other end of the cylinder tube 12, and a seal member 34*b* provided on a side surface of the rod cover 16 contacts the inner surface of the cylinder tube 12, whereby leakage of the pressure fluid having passed between the rod cover 16 and the cylinder tube 12 is prevented.

Moreover, instead of being connected by crimping to the head cover 14 and the rod cover 16, the cylinder tube 12 may be connected to the head cover 14 and the rod cover 16, for example, by welding or the like.

As shown in FIGS. 1 and 3 to 5, the piston unit 18 is provided at one end portion of the piston rod 20, and includes a base body (connected body) 50, a wear ring 52 disposed on an outer peripheral side of the base body 50, a piston packing 54 adjacent to the wear ring 52, a plate body 56 adjacent to the piston packing 54, and a second damper 58, which is disposed adjacent to the plate body 56 closest to the other end side (in the direction of the arrow A) of the piston rod 20.

The base body 50 is formed, for example, in a disk shape from a metallic material, and in the center thereof, a caulking hole 60 is formed in which one end portion of the piston rod 20 is inserted and caulked. The caulking hole 60 is formed in a tapered shape gradually increasing in diameter toward the side of the one end of the piston unit 18 (in the direction of the arrow B), and the one end portion of the piston rod 20 is expanded in diameter in accordance with the shape of the caulking hole 60, whereby the piston rod 20 is connected integrally in a state in which relative displacement in the axial direction (the direction of arrows A and B) is restricted.

Figure 3:
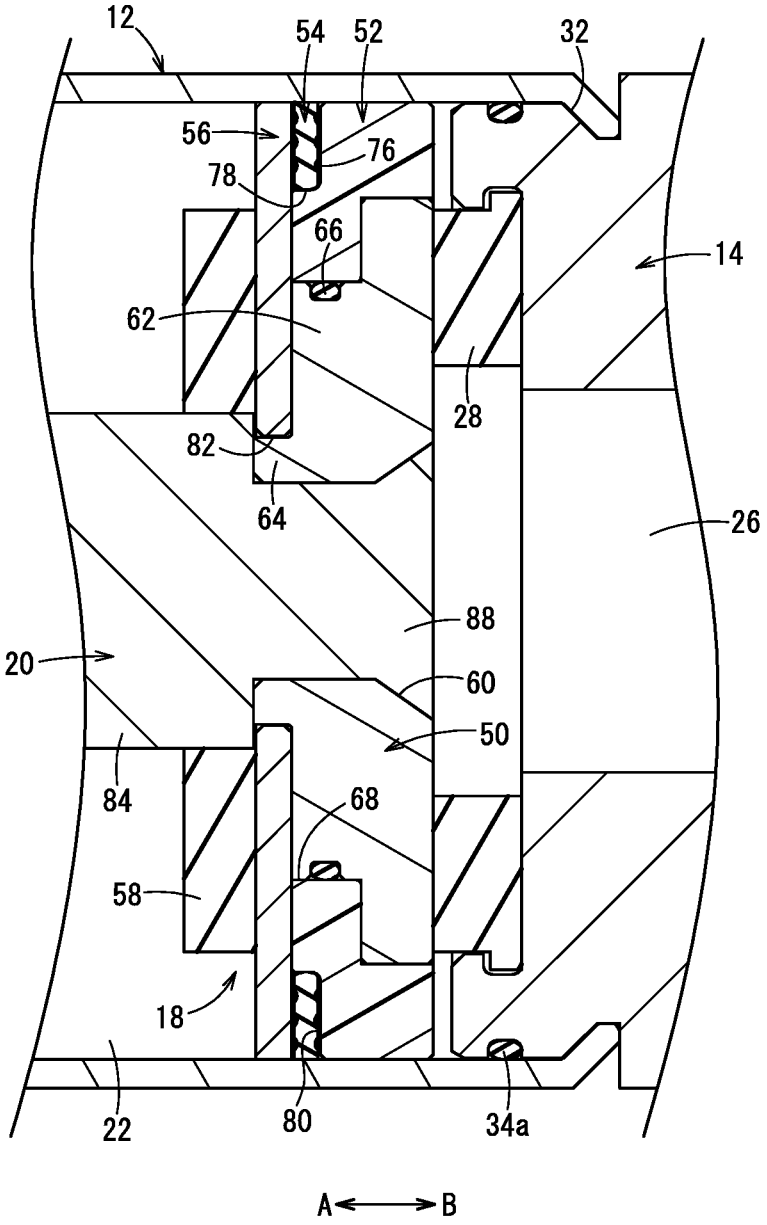
FIG. 3 is an enlarged cross-sectional view showing the vicinity of a piston unit in the fluidic cylinder of FIG. 1.

Further, as shown in FIG. 3, one end portion of the base body 50 is formed in a planar shape perpendicular to the axial line, and on the other end portion thereof, there are formed a first protrusion 62 that protrudes toward the side of the adjacent wear ring 52 (in the direction of the arrow A), and a second protrusion 64 that protrudes further with respect to the first protrusion 62. The first and second protrusions 62, 64 are formed with circular shapes in cross section, and the second protrusion 64 is formed with a smaller diameter than the first protrusion 62. In addition, a ring-shaped gasket (seal member) 66 is installed via an annular groove on the outer circumferential surface of the first protrusion 62.

Figure 4:
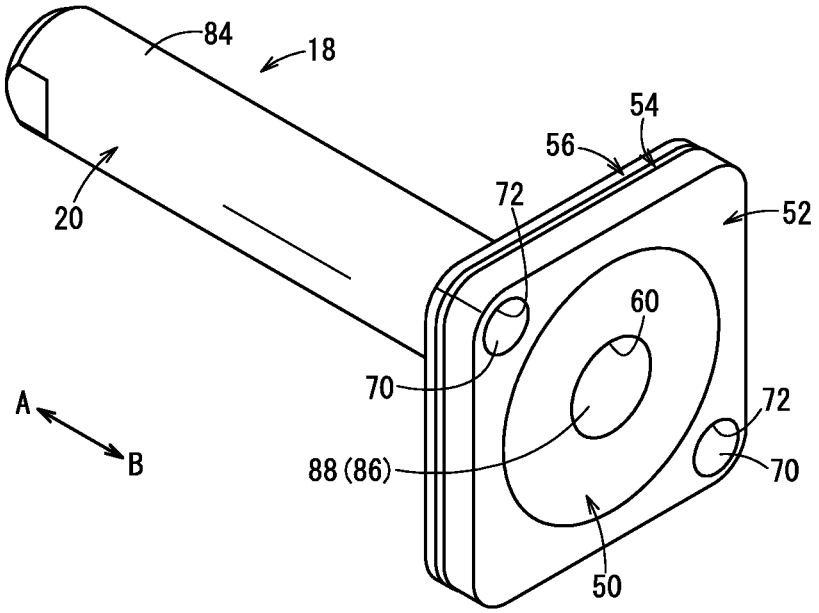
FIG. 4 is an exterior perspective view of the piston unit and a piston rod in the fluidic cylinder of FIG. 1.
Figure 5:
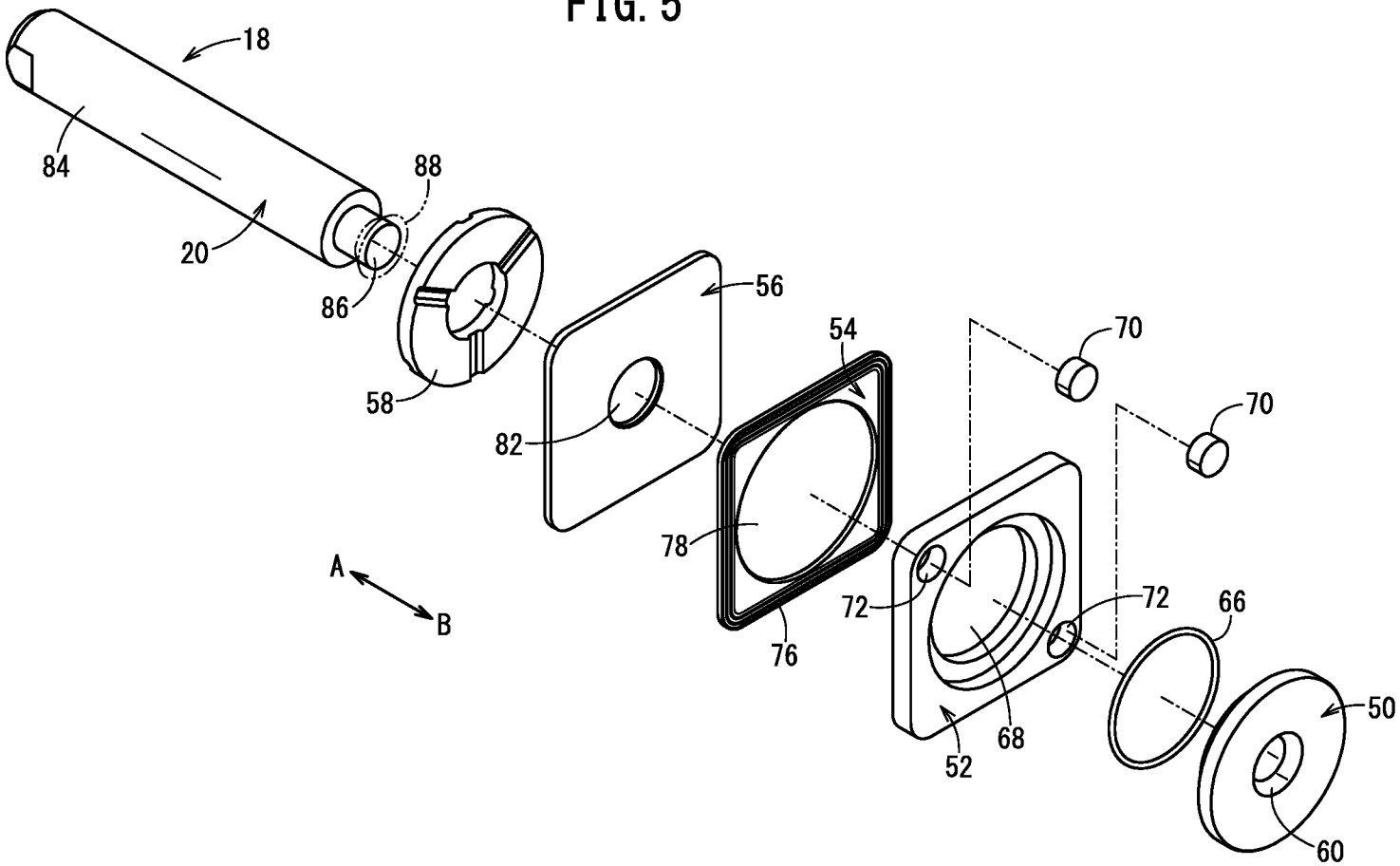
FIG. 5 is an exploded perspective view of the piston unit shown in FIG. 4.
Figure 6:
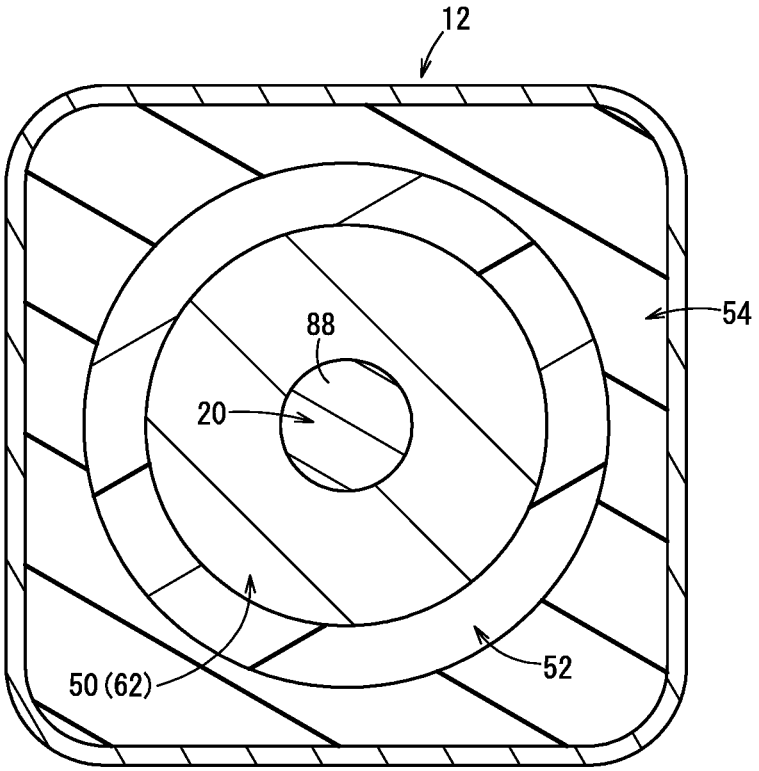
FIG. 6 is a cross-sectional view taken along line VI-VI of FIG. 1.

The wear ring 52 is formed, for example, with a substantially rectangular shape in cross section from a resin, and is formed in a manner so that the outer shape thereof is substantially the same as the cross-sectional shape of the cylinder chamber 22. In the center of the wear ring 52, an attachment hole 68 is formed for attachment of the base body 50, and as shown in FIGS. 4 and 5, a pair of magnet holes 72 in which magnets 70 are mounted are formed on an end surface on one end side (in the direction of the arrow B) of the piston unit 18. Moreover, the attachment hole 68 penetrates along the thickness direction of the wear ring 52 (in the direction of arrows A and B).

The attachment hole 68 is formed in a stepped shape with different diameters in the axial direction (the direction of arrows A and B), and by engagement of the first and second protrusions 62, 64 of the base body 50 thereon, the base body 50 is retained in an accommodated state with respect to the center of the attachment hole 68. At this time, the one end surface of the base body 50 is formed in a coplanar manner so as not to protrude with respect to the one end surface of the wear ring 52 (see FIG. 3).

On the other hand, the magnet holes 72 are formed, for example, in a pair of corners which are arranged diagonally about the attachment hole 68, and the magnet holes 72 open on one end surface side of the wear ring 52 and are formed at a predetermined depth with circular shapes in cross section. In addition, as shown in FIGS. 2 and 4, the magnets 70 are inserted respectively into the magnet holes 72, and are fixed therein, for example, by an adhesive or the like.

Moreover, since the magnets 70 are formed so as to be thinner than the thickness dimension of the wear ring 52, in a state of being accommodated in the magnet holes 72, the magnets 70 are incorporated in the wear ring 52 without protruding from the end surface of the wear ring 52.

Further, as shown in FIG. 2, in a state in which the wear ring 52 having the magnets 70 incorporated therein is accommodated in the cylinder tube 12, the sensor mounting rail 24 is disposed in the vicinity of a corner portion of the cylinder tube 12 in facing relation to the magnet 70.

Figure 7:
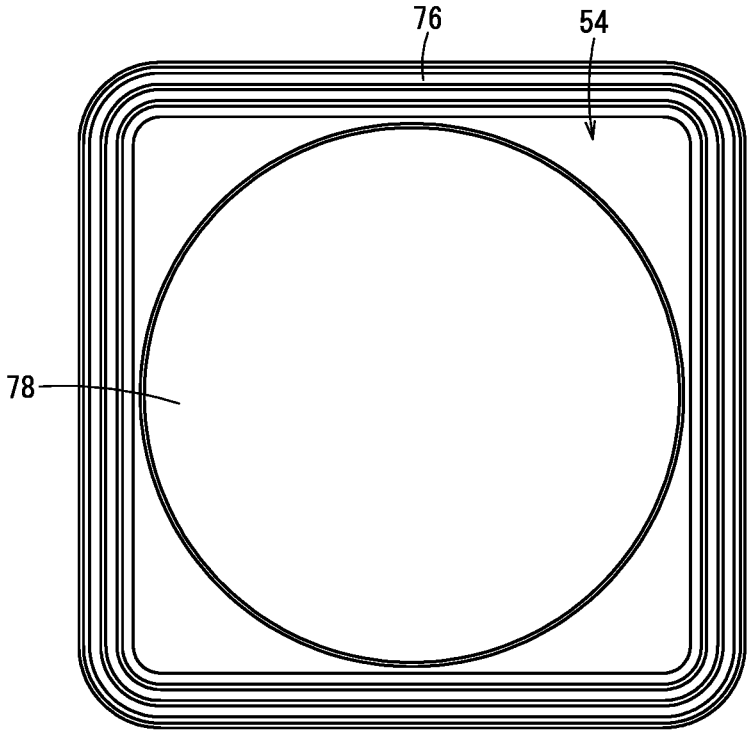
FIG. 7 is a front view of a piston packing.
Figure 8:
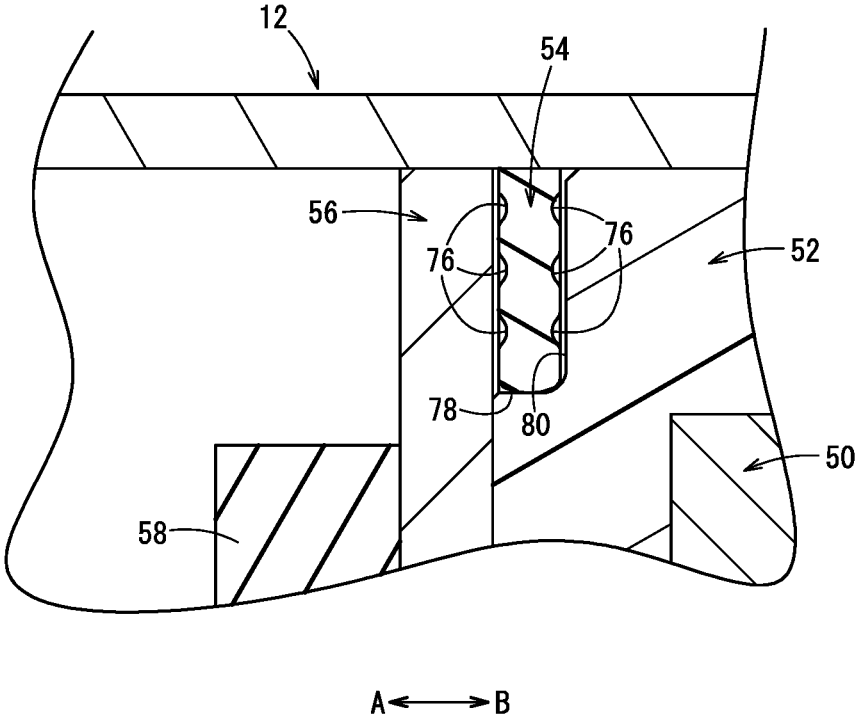
FIG. 8 is an enlarged cross-sectional view showing the vicinity of an outer edge portion of the piston packing of FIG. 3.

As shown in FIGS. 3, 7, and 8, the piston packing 54 is formed with a rectangular shape in cross section from an elastic material such as rubber, for example, and lubricant retaining grooves 76, which are formed in an annular manner, are formed in the vicinity of an outer edge portion on one end surface and the other end surface of the piston packing 54. The lubricant retaining grooves 76 are formed respectively on the one end surface of the piston packing 54 on the side of the wear ring 52 (in the direction of the arrow B), and on the other end surface of the piston packing 54 on the side of the plate body 56 (in the direction of the arrow A), and are formed to be recessed at a predetermined depth in the thickness direction (the direction of arrows A and B) of the piston packing 54, together with being provided in a plurality (for example, three) in parallel while being separated at a predetermined distance.

In addition, for example, a lubricant such as grease or the like is retained in the lubricant retaining grooves 76, and when the piston unit 18 moves in the axial direction (the direction of arrows A and B) along the cylinder tube 12, by supplying the lubricant to the inner wall surface of the cylinder tube 12, lubrication is carried out between the piston unit 18 and the cylinder tube 12.

On the other hand, a packing hole 78 opens in the center of the piston packing 54, and by inserting the piston packing 54 via the packing hole 78 into a recessed part 80 that is formed in the other end surface of the wear ring 52, the other end surface of the piston packing 54 and the other end surface of the wear ring 52 are made substantially flush (see FIG. 3).

The plate body 56 is constituted, for example, from a thin plate made of a metal material having a substantially rectangular shape in cross section, and an insertion hole 82 through which the second protrusion 64 of the base body 50 is inserted opens in the center thereof.

As shown in FIGS. 1, 4 and 5, the piston rod 20 is made up from a shaft having a predetermined length along the axial direction (the direction of arrows A and B), and includes a main body portion 84 formed with a substantially constant diameter, and a small diameter distal end portion 86 formed on the one end of the main body portion 84. A boundary between the distal end portion 86 and the main body portion 84 is formed in a stepped shape, and the piston unit 18 is retained by the distal end portion 86.

Further, as shown in FIG. 1, the other end side of the piston rod 20 is inserted through the rod hole 36 of the rod cover 16, and by the bush 40 that is installed therein, the piston rod 20 is retained in a displaceable manner along the axial direction (the direction of arrows A and B).

In addition, the base body 50 is inserted into the attachment hole 68 from the one end surface side of the wear ring 52, and the plate body 56 is placed in abutment against the other end surface of the wear ring 52 on which the piston packing 54 is mounted. In this state, the piston rod 20 is inserted from the side of the plate body 56, and is inserted into the caulking hole 60 of the base body 50, and in a state in which the plate body 56 abuts against an end portion of the main body portion 84, by crushing and diametrically expanding the distal end portion 86 thereof using a non-illustrated caulking jig or the like, an expanded caulked part 88 is engaged with the caulking hole 60.

Consequently, as shown in FIG. 4, a state is brought about in which the piston unit 18 is retained between the caulked part 88 (distal end portion 86) of the piston rod 20 and the main body portion 84. At this time, between the caulked part 88 and the main body portion 84, slight gaps are included respectively in the axial direction (the direction of arrows A and B) between the base body 50, the wear ring 52, and the plate body 56, and therefore, a state exists in which the wear ring 52, the piston packing 54, and the plate body 56 are retained in a rotatable manner about the piston rod 20.

Further, in the case that relative rotation of the wear ring 52 and the plate body 56 with respect to the piston rod 20 is restricted, for example, the thickness dimension of the first protrusion 62 at the plate body 56 and the wear ring 52 is set to be large, whereby gaps between the base body 50, the wear ring 52, and the plate body 56 are eliminated, and they are kept in close contact with each other. Consequently, relative rotation of the wear ring 52 and the plate body 56 with respect to the piston rod 20 is restricted, and the piston rod 20 and the piston unit 18 can be constructed integrally. More specifically, such a situation is suitable for a case in which it is undesirable for the piston rod 20 to be rotated with respect to the piston unit 18.

The fluidic cylinder 10 according to the embodiment of the present invention is constructed basically as described above. Next, operations and advantageous effects of the fluidic cylinder 10 will be described. A condition in which the piston unit 18 shown in FIG. 1 is displaced to the side of the head cover 14 (in the direction of the arrow B) will be described as an initial position.

At first, a pressure fluid is introduced into the first fluid port 30 from a non-illustrated pressure fluid supply source. In this case, the second fluid port 44 is placed in a state of being open to atmosphere under a switching operation of a non-illustrated switching valve.

Consequently, the pressure fluid is supplied to the communication hole 26 from the first fluid port 30, and by the pressure fluid that is introduced into the cylinder chamber 22 from the communication hole 26, the piston unit 18 is pressed toward the side of the rod cover 16 (in the direction of the arrow A). In addition, the piston rod 20 is displaced together therewith under a displacement action of the piston unit 18, and the second damper 58 abuts against the rod cover 16, thereby reaching a displacement end position.

On the other hand, in the case that the piston unit 18 is displaced in the opposite direction (in the direction of the arrow B), together with the pressure fluid being supplied to the second fluid port 44, the first fluid port 30 is placed in a state of being open to atmosphere under a switching operation of the switching valve (not shown). In addition, the pressure fluid is supplied from the second fluid port 44 through the communication passage 46 to the cylinder chamber 22, and by the pressure fluid that is introduced into the cylinder chamber 22, the piston unit 18 is pressed toward the side of the head cover 14 (in the direction of the arrow B).

In addition, the piston rod 20 is displaced together therewith under the displacement action of the piston unit 18, and by the base body 50 of the piston unit 18 coming into abutment against the first damper 28 of the head cover 14, the initial position is restored (see FIG. 1).

Next, for the purpose of improving the mounting ability when the fluidic cylinder 10 is mounted with respect to other members D1, D2, D3, a fluidic cylinder 100 will be described in which a rod cover 102 according to a modification is used.

Figure 9:
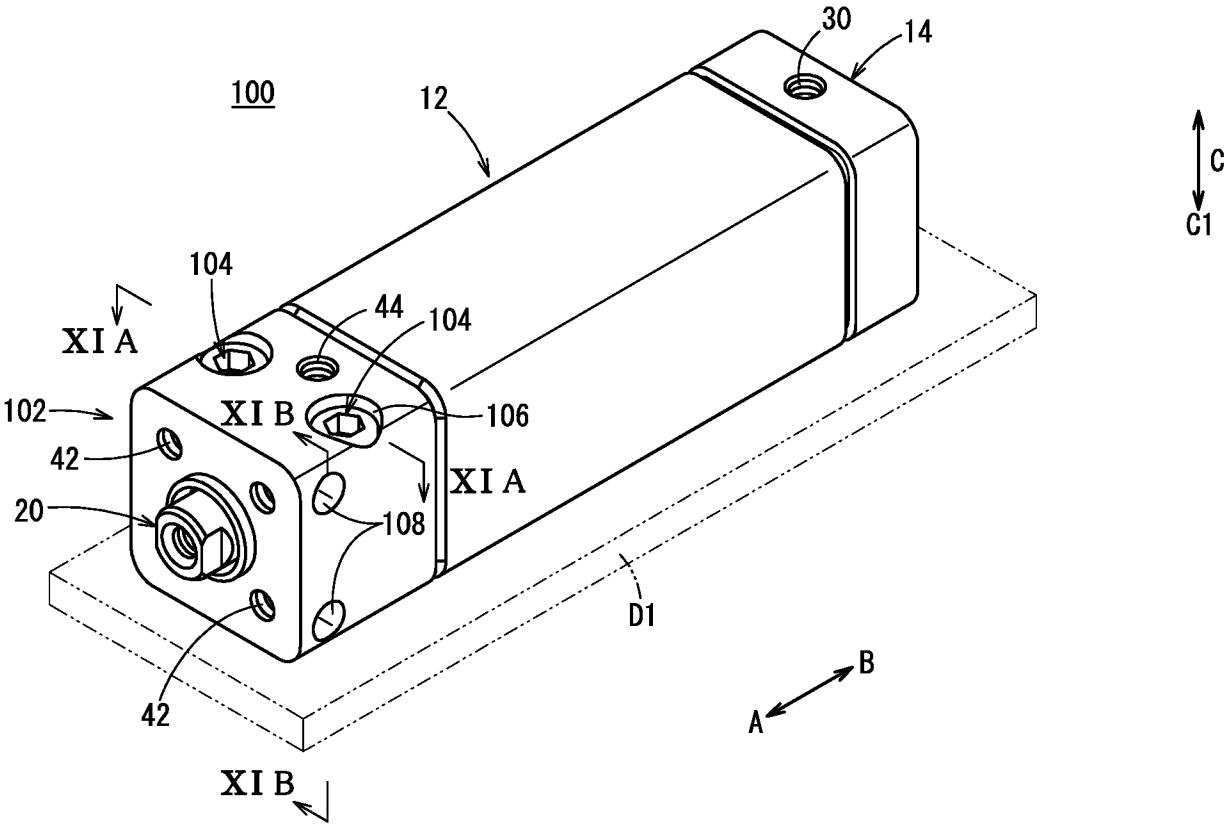
FIG. 9 is an external perspective view of the fluidic cylinder in which a rod cover according to a modified example is used.
Figure 10:
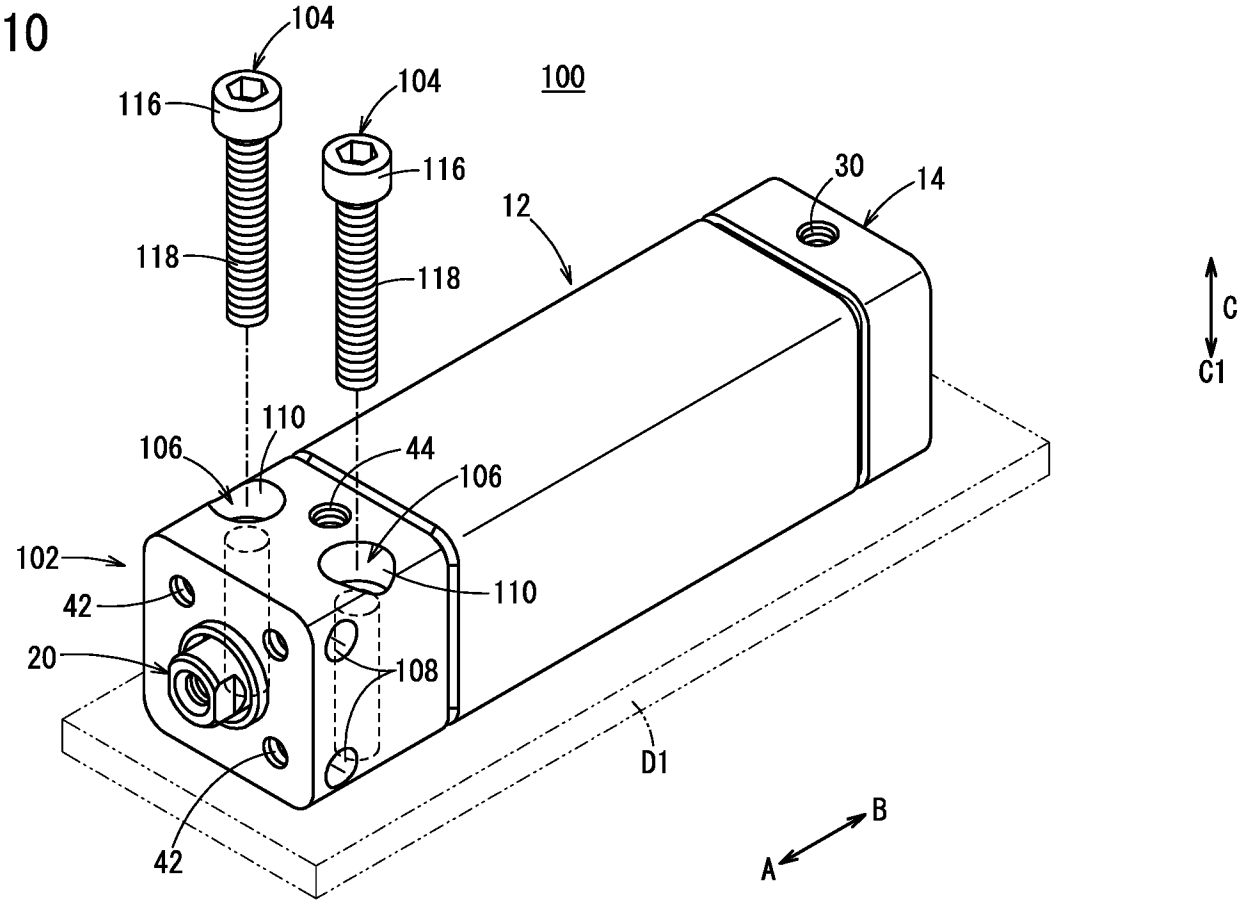
FIG. 10 is an exterior perspective view showing a state prior to assembly, of a case in which the fluidic cylinder of FIG. 9 is fixed to another member arranged on a lower side thereof.

In such a fluidic cylinder 100, as shown in FIGS. 9 and 10, a pair of first bolt holes 106 through which fixing bolts 104 are inserted are formed in an upper surface of the rod cover 102 where the second fluid port 44 opens, together with a pair of second bolt holes 108 being formed on a side surface perpendicular to the upper surface.

As shown in FIGS. 9 through 11A, the first bolt holes 106 are provided so as to penetrate in a direction (the direction of the arrow C) perpendicular to the axial direction (the direction of arrows A and B) of the rod cover 102, and are separated from each other. More specifically, the first bolt holes 106 are provided at a position which is closer to an end side (in the direction of the arrow A) of the rod cover 102 than the second fluid port 44, and penetrate along a height direction (in the direction of the arrow C) of the rod cover 102.

Figure 11A:
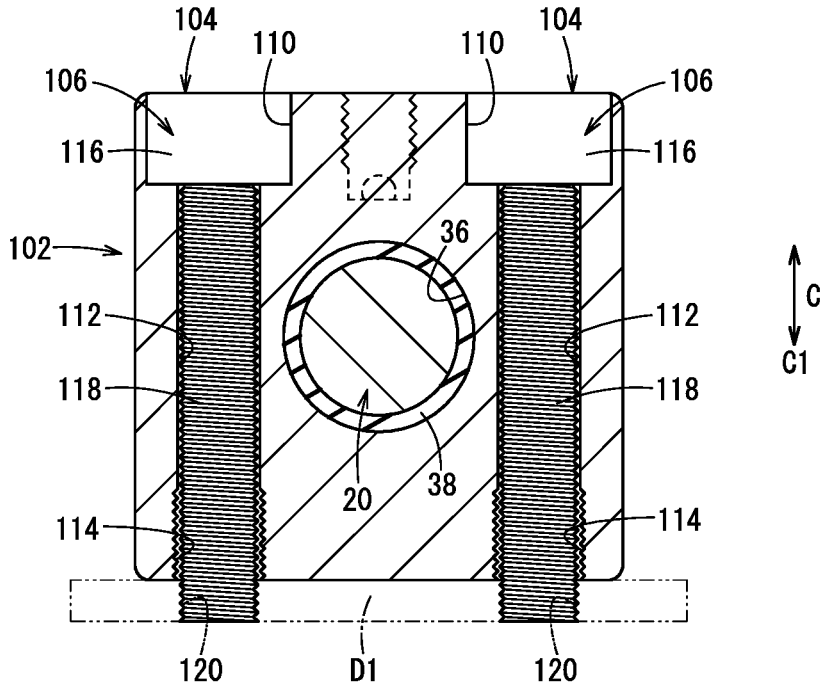
FIG. 11A is a cross-sectional view taken along line XIA-XIA of FIG. 9.

Further, as shown in FIG. 11A, the first bolt holes 106 are made up from accommodating sections 110 in which head portions 116 of the fixing bolts 104 are accommodated, insertion parts 112 that extend downward (in the direction of the arrow C1) and have a smaller diameter than the accommodating sections 110, and threaded portions 114 formed at lower ends of the insertion parts 112 and having screw threads engraved therein.

Figure 11B:
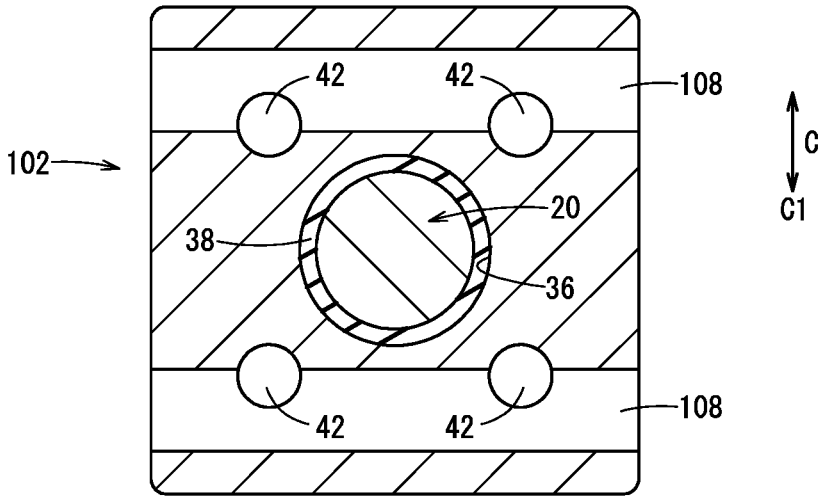
FIG. 11B is a cross-sectional view taken along line XIB-XIB of FIG. 9.

On the other hand, as shown in FIGS. 10 and 11B, the second bolt holes 108 are provided so as to be separated from each other in the height direction (the direction of the arrow C) of the rod cover 102, extend respectively in a horizontal direction perpendicular to the axial direction of the first bolt holes 106 and the rod cover 102, and penetrate through one side surface and the other side surface, together with being formed in straight line shapes with a substantially constant diameter. Further, the second bolt holes 108 are formed at a position that is more closer to the end side (in the direction of the arrow A) of the rod cover 102 than the first bolt holes 106.

In addition, as shown in FIGS. 9 through 11A, in the case that the fluidic cylinder 100 is fixed to another member D1 provided on a lower surface side thereof, in a condition with the lower surface of the rod cover 102 abutting against the other member D1, the fixing bolts 104 are inserted in and through the first bolt holes 106 from above. Then, the head portions 116 thereof are accommodated in the accommodating sections 110, and by the fastening members 118 provided with threads on the outer circumferential surfaces thereof being inserted through the insertion parts 112 and the threaded portions 114, and screw-engaged into screw holes 120 of the other member D1, the rod cover 102 is fixed by the fixing bolts 104 to the upper surface of the other member D1. Moreover, the fastening members 118 of the fixing bolts 104 are formed to have a smaller diameter than the insertion parts 112 and the threaded portions 114.

Consequently, the fluidic cylinder 100 including the rod cover 102 is fixed in a state of being placed on the upper surface of the other member D1. Stated otherwise, the fluidic cylinder 100 is fixed on the lower side surface thereof with respect to the other member D1.

Figure 12:
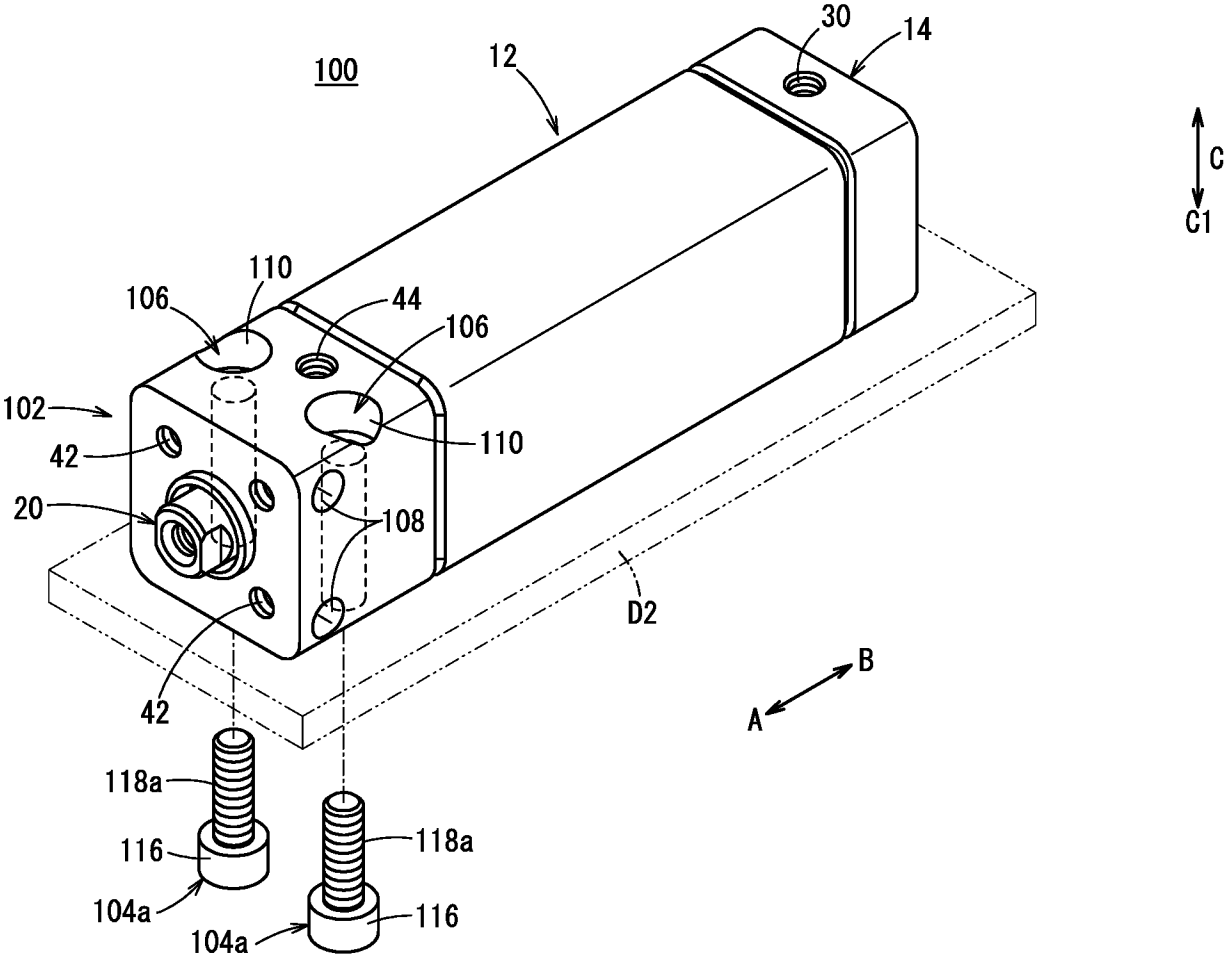
FIG. 12 is a perspective view showing a state prior to assembly, of a case in which another member is fixed by fixing bolts from a lower side with respect to the fluidic cylinder of FIG. 9.
Figure 13:
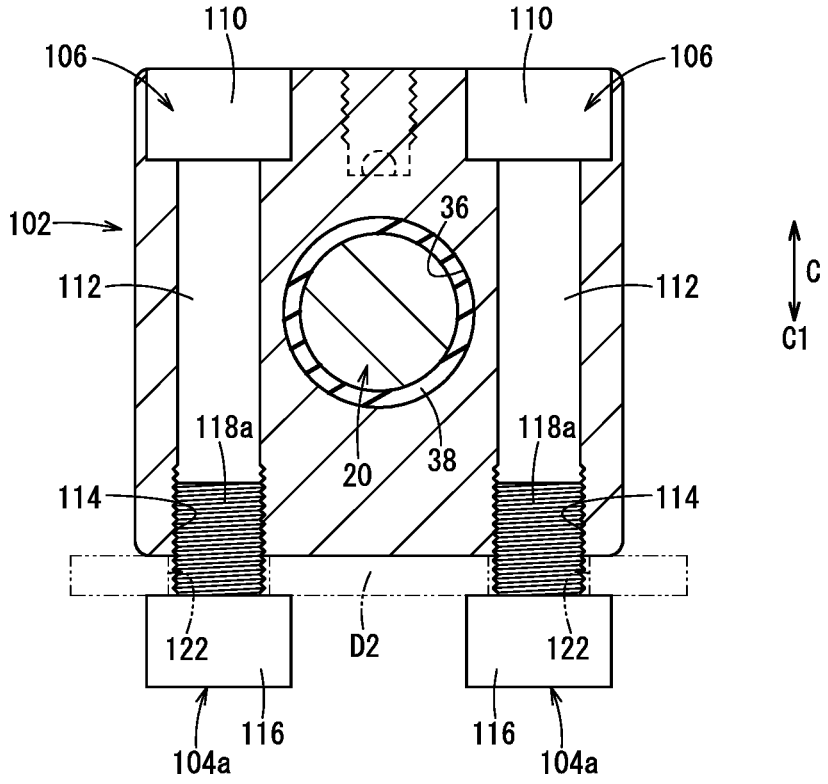
FIG. 13 is a cross-sectional view showing a state in which the fluidic cylinder of FIG. 12 is fixed to the other member.

Further, as shown in FIGS. 12 and 13, depending on the environment of use and the purpose for which the fluidic cylinder 100 is to be used, in the case that the fluidic cylinder 100 is fixed by fixing bolts 104*a* from a lower side of another member D2, fastening members 118*a* of the fixing bolts 104*a* are inserted from below through the first bolt holes 106 via holes 122 formed in the other member D2. Then, by the fastening members 118*a* being screw-engaged in the threaded portions 114, as shown in FIG. 13, the other member D2 is fixed by the fixing bolts 104*a* to the lower surface of the rod cover 102. Consequently, the fluidic cylinder 100 including the rod cover 102 is fixed in a state of being placed on the upper surface of the other member D2. Moreover, the insertion parts 112 are formed with a smaller diameter than the fastening members 118*a* on the fixing bolts 104*a*.

Figure 14:
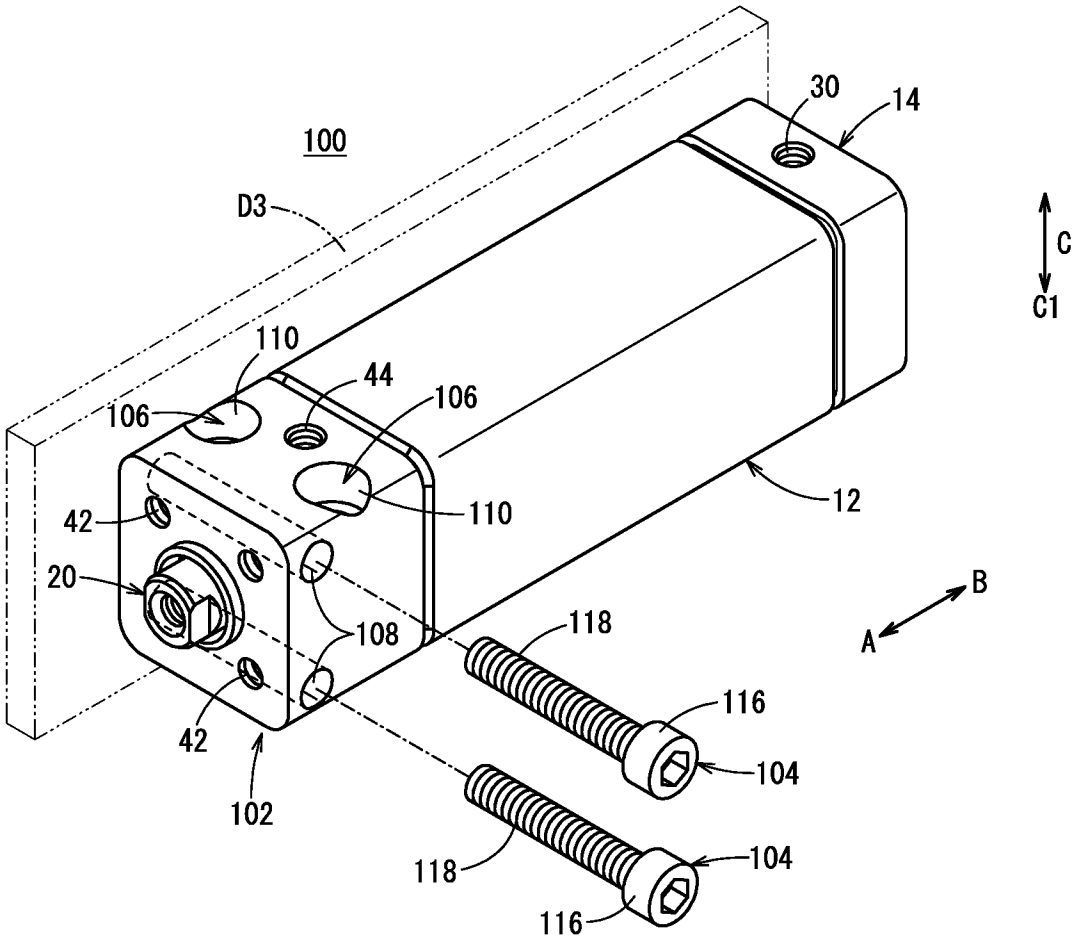
FIG. 14 is an exterior perspective view showing a state prior to assembly, of a case in which the fluidic cylinder of FIG. 9 is fixed to another member arranged on one side thereof.
Figure 15:
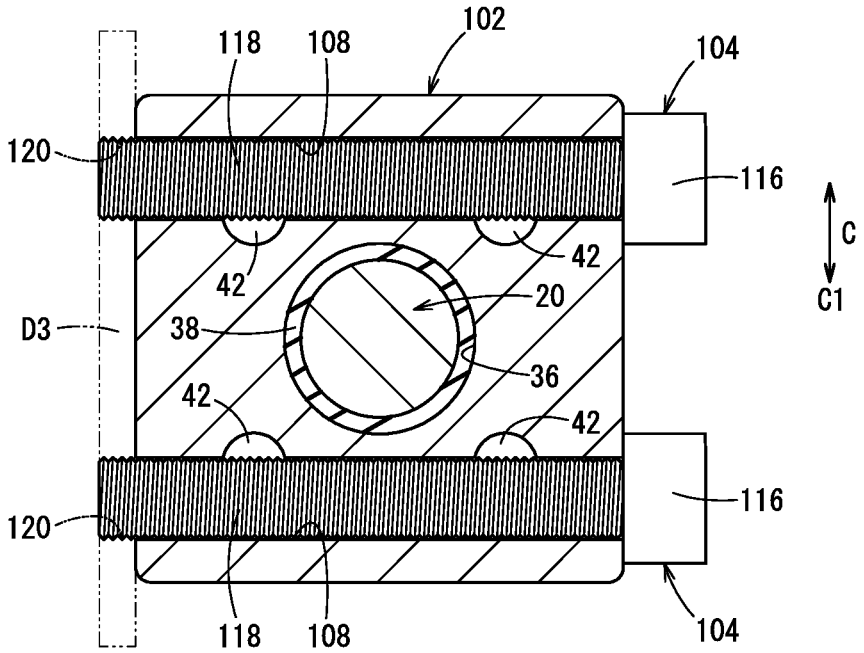
FIG. 15 is a cross-sectional view showing a state in which the fluidic cylinder of FIG. 14 is fixed to the other member.

Furthermore, depending on the environment of use and the purpose for which the fluidic cylinder 100 is to be used, in the case that the fluidic cylinder 100 is fixed to one side of another member D3 as shown in FIGS. 14 and 15, in a state in which the other member D3 is brought into contact with the one side surface on the rod cover 102, the fixing bolts 104 are inserted through the second bolt holes 108 from the other side surface side, and the fastening members 118 that project out from the one side surface of the second bolt holes 108 are screw-engaged into the screw holes 120 of the other member D3. Consequently, via the fixing bolts 104, the fluidic cylinder 100 can be mounted laterally to one side of the other member D3. Stated otherwise, the fluidic cylinder 100 is fixed to the other member D3 on a side surface side thereof.

As described above, according to the present embodiment, the piston unit 18 constituting the fluidic cylinder 10 is formed with a rectangular shape in cross section, together with the cylinder tube 12 in which the piston unit 18 is accommodated in the interior thereof being formed with a corresponding rectangular shape in cross section. Thus, in the case that the diameter of the piston and the length of one side of the piston unit 18 are substantially equivalent, it is possible to secure a large pressure receiving area, in comparison with a fluidic cylinder in which the piston thereof has a circular cross section. As a result, it is possible to increase the thrust force in the fluidic cylinder 10, and together therewith, it is possible to drive the fluidic cylinder 10 even if the pressure fluid supplied to the cylinder chamber 22 is of a low pressure, and by reducing the consumption amount of the pressurized fluid, an energy savings can be achieved.

In addition, a configuration is provided in which the piston unit 18 includes the wear ring 52, which enables guidance along the axial direction (in the directions of the arrows A and B) by being placed in sliding contact with the inner wall surface of the cylinder tube 12, and in which the magnets 70 can be incorporated in the interior of the wear ring 52. Thus, the axial dimension of the piston unit 18 can be suppressed in comparison with a case in which the wear ring 52 and the magnets 70 are disposed in parallel in the axial direction on the outer peripheral surface of the piston, and therefore, it is possible to reduce the size and scale of the fluidic cylinder 10.

Furthermore, by forming the first and second bolt holes 106, 108 through which the fixing bolts 104, 104*a* can be inserted, and which have different penetrating directions in the rod cover 102, since the fluidic cylinder 100 can be fixed from various directions with respect to the other members D1, D2, D3, it is possible for the fluidic cylinder 100 to be fixed in various ways depending on the environment of use or the like of the fluidic cylinder 100. Further, by using the attachment holes 42 provided in the end surfaces of the rod covers 16, 102, it is also possible to fix another member in the axial direction (the direction of the arrow A) of the fluidic cylinder 100.

Further still, the above-described first and second bolt holes 106, 108 are not limited to the case of being provided in the rod cover 102, and for example, may be provided in the head cover 14 and enable fixing by the fixing bolts 104, 104*a*.

The fluidic cylinder according to the present invention is not limited to the above embodiments. It is a matter of course that various changes and modifications may be made to the embodiments without departing from the scope of the invention as set forth in the appended claims.

The invention claimed is:

1. A fluidic cylinder comprising:

a cylinder tube having a cylinder chamber defined in an interior thereof, a pair of cover members attached to respective ends of the cylinder tube, a piston disposed displaceably along the cylinder chamber, and a piston rod that is connected to the piston, wherein each of the piston and the cylinder tube are formed with rectangular shapes in cross section, the piston includes a wear ring which is in sliding contact with an inner wall surface of the cylinder tube, and a magnet is incorporated in the wear ring, and wherein said cover members each include a first bolt hole formed in an end surface in a longitudinal direction of the respective cover member, a second bolt hole formed on an upper surface perpendicular to the end surface, a third bolt hole formed on a side surface perpendicular to the upper surface, the first bolt hole crosses part of the third bolt hole and intersects a sectional area of the third bolt hole over more than one half of a sectional area of the first bolt hole as seen in the longitudinal direction of the respective cover member, and fastening bolts are selectively inserted into the first to third bolt holes to fix said at least one of said cover members with respect to another member.

* * * * *